US005670841A

United States Patent [19]

Muti et al.

[11] Patent Number: 5,670,841

[45] Date of Patent: Sep. 23, 1997

[54] ELECTRON GUN FOR A CATHODE RAY TUBE HAVING A PLURALITY OF ELECTRODES LAYERS FORMING A MAIN LENS

[75] Inventors: Tsuneo Muti, Kanagawa; Tsunenari Saito, Tokyo, both of Japan

[73] Assignee: Sony Corporation, Tokyo, Japan

[21] Appl. No.: 172,733

[22] Filed: Dec. 27, 1993

[30] Foreign Application Priority Data

Dec. 28, 1992 [JP] Japan ..... 4-349368
Jan. 21, 1993 [JP] Japan ..... 5-008557

[51] Int. Cl.[6] ..... H01J 29/58

[52] U.S. Cl. ..... 313/450; 313/412

[58] Field of Search ..... 313/450, 409, 313/412, 456, 451

[56] References Cited

U.S. PATENT DOCUMENTS 5,015,925 5/1991 Spanjer ..... 313/450
5,045,751 9/1991 Numata ..... 313/450
5,202,606 4/1993 Vrijssen ..... 313/450

FOREIGN PATENT DOCUMENTS 0 327 149 8/1989 European Pat. Off. .
0 362 922 4/1990 European Pat. Off. .
0 454 215 10/1991 European Pat. Off. .

OTHER PUBLICATIONS

T. Spanjer et al., "A Compact High-resolution Electron Gun With Electrostatic Focus For Projection CRTs", *Proceedings of the SID*, vol. 32, No. 4, 1991, pp. 273–278.

Kinjirou Gunbe, "Electrostatic Focusing Image Pickup Tube", *Patent Abstracts of Japan*, vol. 7, No. 27, (E-156) (1172) Feb. 3, 1983.

*Primary Examiner*—Sandra L. O'Shea
*Assistant Examiner*—Vip Patel
*Attorney, Agent, or Firm*—Hill, Steadman & Simpson

[57] ABSTRACT

An electron gun having at least one tube, a pair of holders for holding both ends of the tube, a plurality of electrode layers which are provided on the inner surface of the tube so as to form a part of a main lens, at least one conductive layer provided on the surface of the tube, and a plurality of electrodes for forming a part of triode. Also, a method of manufacturing an electron gun comprises the steps of forming a plurality of electrode layers on the inner surface of at least one tube, providing at least one conductive layer on the surface of the tube, providing a pair of holders so as to hold both ends of said tube, providing a voltage supplying device on one of the pair of holders, and welding a plurality of electrodes forming a part of a triode to the other of the pair of holders.

6 Claims, 18 Drawing Sheets

ELECTRON GUN FOR A CATHODE RAY TUBE HAVING A PLURALITY OF ELECTRODES LAYERS FORMING A MAIN LENS

BACKGROUND OF THE INVENTION

1. Field of the Invention

The present invention relates to an electron gun for a cathode ray tube used in a projector tube, a color picture tube, an index tube or the like, for example, and a manufacturing method thereof 2. Description of the Prior Art FIG. 1 of the accompanying drawings shows an example of an electron gun for a cathode ray tube according to the prior art.

This conventional electron gun is of a unipotential type in which first to fifth grids $G_1$ to $G_5$ serving as acceleration and converging electrodes are disposed on the same axis (Z axis) in alignment with a cathode K from which electron beams are emitted, as shown in FIG. 1. The electron beam emitted from the cathode K is converged on a phosphor screen (not shown) by action of a pre-focus lens formed of the second and third grids $G_2$ and $G_3$ and a main lens formed of the third to fifth grids $G_3$ to $G_5$. These cathode K and first through fifth grids $G_1$ to $G_5$ are fixed to a beading glass by melt bonding and assembled unitarily. The first to fifth grids $G_1$ to $G_5$ are made of a metal such as a stainless steel or the like.

An example of the above conventional electron gun, however, encountered with the problems which follow:

In the arrangement of the above electron gun, a displacement tends to occur in concentricity among the electrodes, in particular, the third to fifth grids $G_3$ to $G_5$ so that an electron beam is shifted from the axis to cause a so-called defocusing.

Further, a potential difference among the electrodes occurs in a step-wise fashion so that discharge tends to occur among the third to fifth grids $G_3$ to $G_5$. Furthermore, a spherical aberration of a lens system becomes large, which makes a spot diameter of electron beam large.

OBJECTS AND SUMMARY OF THE INVENTION

Therefore, it is an object of the present invention to provide an improved electron gun in which the aforesaid shortcomings and disadvantages of the prior art can be eliminated and an improved manufacturing method thereof.

More specifically, it is an object of the present invention to provide an electron gun in which an axial displacement of an electron beam can be reduced by suppressing a displacement of a concentricity of a main lens system and a manufacturing method thereof.

It is another object of the present invention to provide an electron gun in which a discharge among electrodes can be prevented by reducing a potential gradient among the electrodes forming a main lens and a manufacturing method thereof.

It is a further object of the present invention to provide an electron gun in which a spherical aberration of a main lens can be reduced and a manufacturing method thereof.

According to a first aspect of the present invention, there is provided an electron gun which comprises at least one tube, a pair of holders for holding both ends of the tube, a plurality of electrode layers which are provided on the inner surface of the tube so as to form a part of a main lens, at least one conductive layer provided on the surface of the tube, and a plurality of electrodes for forming a part of a triode.

According to a second aspect of the present invention, there is provided a method of manufacturing an electron gun which comprises the steps of forming a plurality of electrode layers on the inner surface of at least one tube, providing at least one conductive layer on the surface of the tube, providing a pair of holders so as to hold both ends of the tube, providing a voltage supplying device on one of the pair of holders, and welding a plurality of electrodes which form a part of a triode to the other of the pair of holders.

The above and other objects, features, and advantages of the present invention will become apparent from the following detailed description of illustrative embodiments thereof to be read in conjunction with the accompanying drawings, in which like reference numerals are used to identify the same or similar parts in the several views.

DETAILED DESCRIPTION OF THE PREFERRED EMBODIMENTS

An electron gun for a cathode ray tube according to a first embodiment of the present invention will hereinafter be described with reference to FIG. 2 through FIGS. 20A and 20B.

Figure 1:
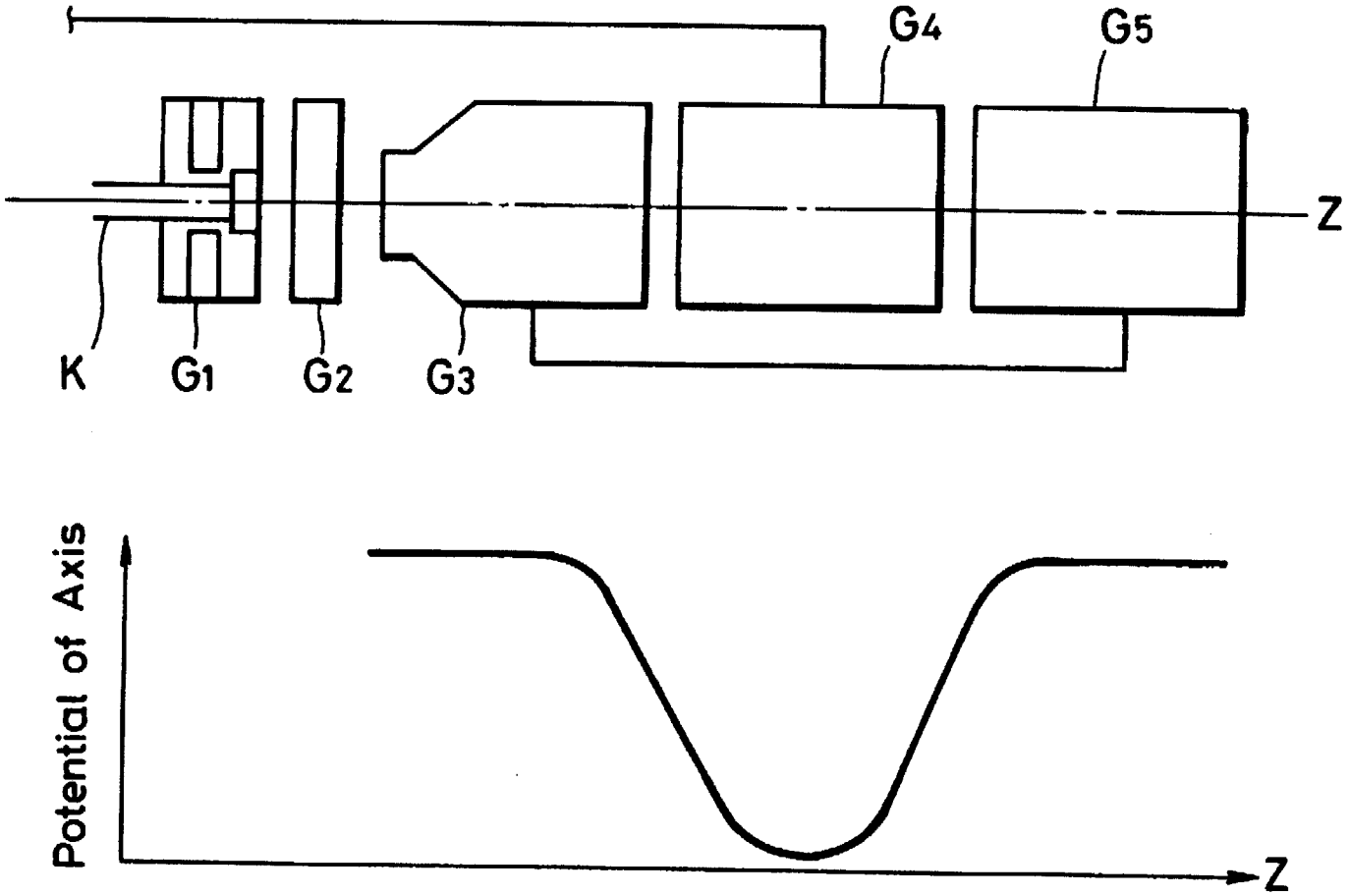
FIG. 1 (PRIOR ART)
FIG. 1 is a schematic diagram showing an arrangement of a conventional electron gun.
Figure 2:
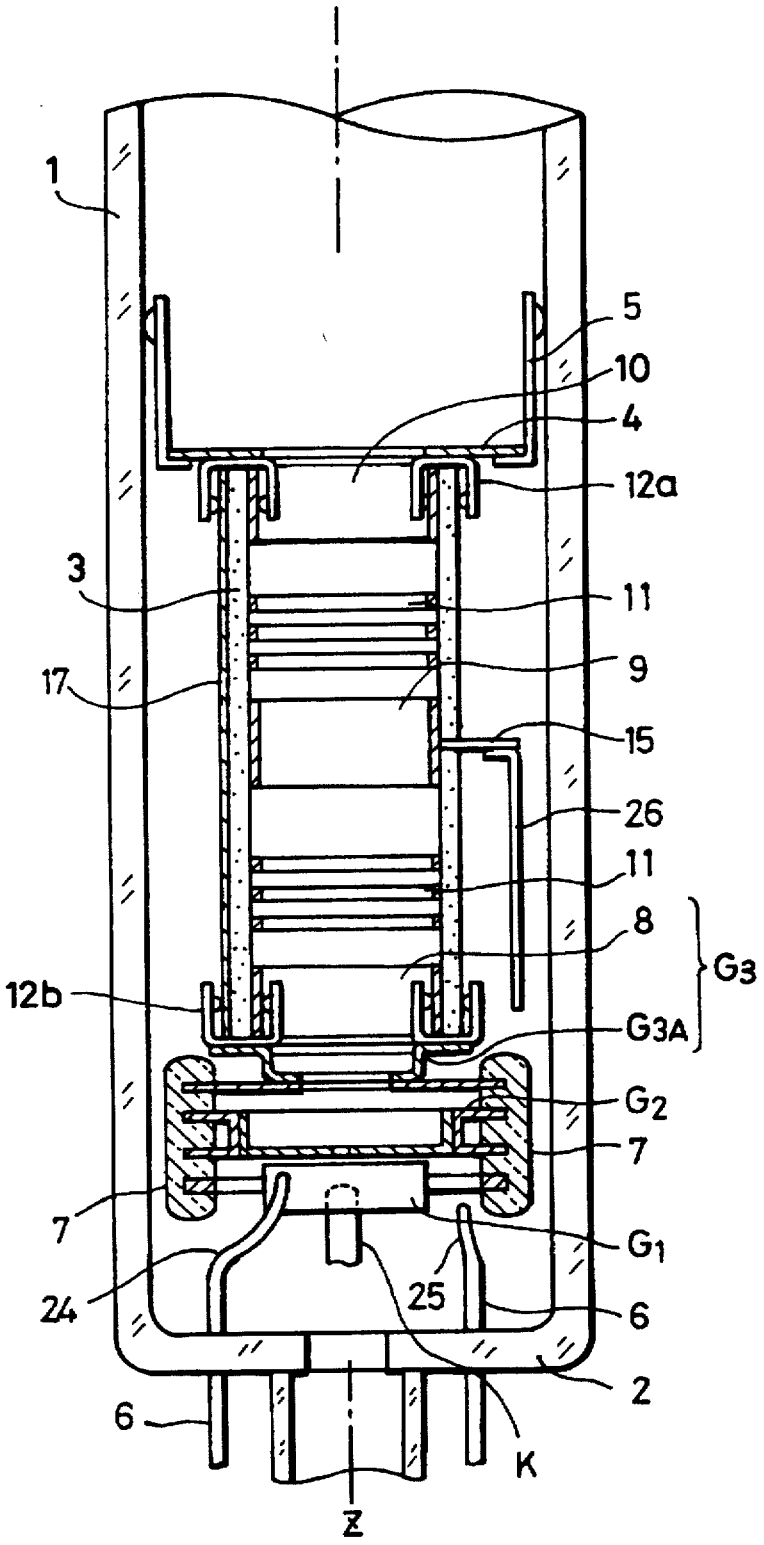
FIG. 2 is a cross-sectional view showing an overall arrangement of an electron gun according to a first embodiment of the present invention.

FIG. 2 shows an overall arrangement of the electron gun according to the first embodiment of the present invention. The electron gun according to this embodiment is of a unipotential type. As shown in FIG. 2, according to this embodiment, a neck tube 1 includes at a portion near its stem 2 a cathode K which emits an electron beam. A cup-shaped member $G_{3A}$ that constructs a first grid $G_1$, a second grid $G_2$ and a third grid $G_3$ is disposed adjacent to the cathode K so as to become coaxial with the neck tube 1. A high resistance tube 3, which is used to form a main lens as will be described later on, is provided at the position adjoining the cup-shaped member $G_{3A}$ coaxial with the neck tube 1. The high resistance tube 3 includes an HV (high voltage) shield 4 and an HV spring 5 fixed to its upper end portion. The stem 2 includes a plurality of stem pins 6 embedded thereto.

A cut-off voltage that controls a beam amount is applied to the first grid $G_1$. A voltage that is positively higher than the cathode voltage of the cathode K by about several 100s of Volts is applied to the second grid $G_2$ adjacent to the first grid $G_1$. The cup-shaped member $G_{3A}$ which constructs the first grid $G_1$, the second grid $G_2$ and the third grid $G_3$ is fixed to a pair of bead glass 7 disposed at both sides of the cup-shaped member $G_{3A}$ by melt bonding, thereby forming a triode.

A lead wire 24 of the first grid $G_1$ and a lead wire 25 of the second grid $G_2$ are respectively connected to the stem pins 6 to thereby fix the triode.

The high resistance tube 3 is made of a conductive material which is rendered electrically conductive by mixing and sintering oxides such as Ti (titanium), W (tungsten), Cu (copper) or the like into alumina ($Al_2O_3$), for example, and a material such as ferrite, titanium-based ceramics or the like which is also rendered electrically conductive. This material has a main component of an insulating material having a high withstand voltage property.

The high resistance tube 3 is cylinder in shape and is high in degree of true circle (e.g., smaller than 20 μm). The high resistance tube 3 is coated on its inner surface at its respective end portions and at its central portion with ring-shaped electrode layers 8, 9, 10 made of $RUO_2$-glass paste, for example. The electrode layer 8 constructs the third grid $G_3$together with the cup-shaped member $G_{3A}$, and the electrode layers 9, 10 serve as the fourth grid $G_4$ and the fifth grid $G_5$, respectively. Portions between the adjacent electrode layers 8, 9, 10, there are provided a plurality of ring-shaped portions (hereinafter referred to as conductive rings) made of the same materials as those of the electrode films 8 to 10, for example. The electrode layers 8 to 10 and the conductive rings 11 are all formed in the direction perpendicular to the longitudinal direction of the high resistance tube 3, i.e., tube axis (Z axis) direction.

It is preferable that a resistance value of the high resistance tube 3 is set in a range of from 100MΩ to 10TΩ between the electrode layers 8 and 9 and between the electrode layers 9 and 10 if a diameter of the high resistance tube 3 and a spacing between the electrode layers 8, 9 and a spacing between the electrode layers 9, 10 are selected to be about 12 mm, respectively. More preferably, the resistance value of the high resistance tube 3 is set to be about 1 GΩ. If the resistance value of the high resistance tube 3 is selected to be a value smaller than the above value, then the high resistance tube 3 tends to generate a heat. If on the other hand the resistance value of the high resistance tube 3 is selected to be larger than the above value, then the high resistance tube 3 tends to be electrified. Incidentally, if the above resistance value is set to be 1 GΩ, then a volume resistivity of the high resistance tube 3 becomes $10^8$Ω.cm.

The high resistance tube 3 is coated on one outer surface thereof with a conductive layer 17 extended in its longitudinal direction.

Further, there is formed a resistance layer 11 in such a fashion that the resistance layer 11 is partly overlapped on the electrode layers or films 8, 10 provided at the respective ends and that the resistance layer 11 is wholly overlapped on the electrode layer 9 provided at the central portion. Alternatively, the resistance layer 11 may be formed in a spiral fashion (helical fashion) among the electrode layers 8, 9 and 10.

Figure 3A:
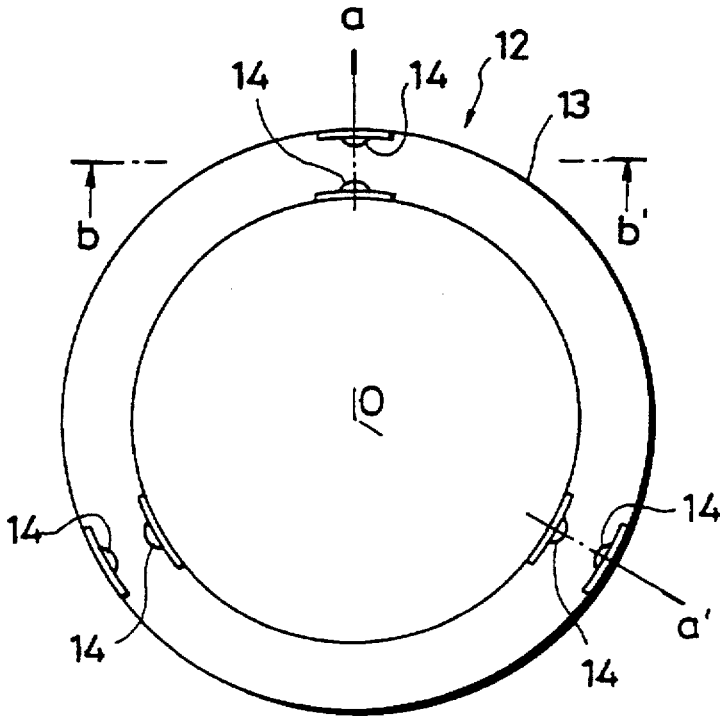
FIG. 3A is a front view showing a cylindrical holder used in the first embodiment of the present invention.
Figure 3B:
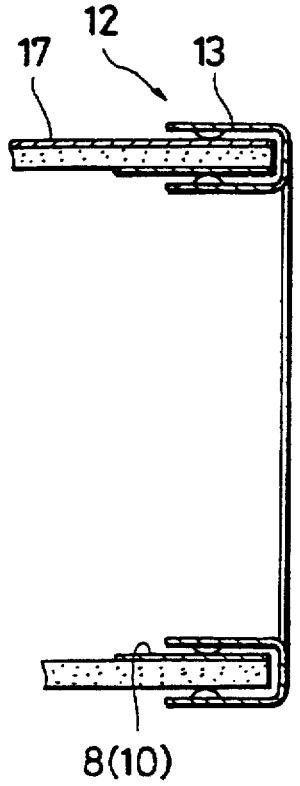
FIG. 3B is a cross-sectional view taken through a line a–0–a' in FIG. 3A.
Figure 3C:
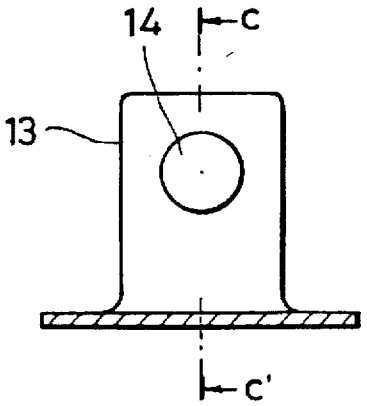
FIG. 3C is a cross-sectional view taken through a line b–b' in FIG. 3A.
Figure 3D:
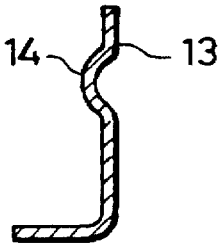
FIG. 3D is a cross-sectional view taken through a line c–c' in FIG. 3C.

The high resistance tube 3 includes at its respective ends fixed cylindrical holders 12 (12*a*, 12*b*) which are used to connect the electrode films 8 and 10 electrically. The cylindrical holder 12 is made of a metal such as a stainless steel or the like, for example. Also, the cylindrical holder 12 includes a ring-shaped flange portion 13 fitted into the high resistance tube 3 as shown in FIGS. 3A to 3C. A pair of opposing protrusions 14 are provided on the inner periphery of the ring-shaped flange portion 13 at its three places. Inside protrusions of these protrusions 14 are brought in contact with the electrode films 10, 12 formed on the inner surface of the high resistance tube 3. The cylindrical holder 12*a* and the cylindrical holder 12*b* are electrically connected to each other via the conductive layer 17 formed on the outer surface of the high resistance tube 3.

Referring back to FIG. 2, the high resistance tube 3 includes at its substantially central portion a $G_4$ pin 15. It is preferable that the $G_4$ pin 15 is made of cobalt iron or Ti alloy having an expansion coefficient substantially equal to that of the high resistance tube 3. The $G_4$ pin 15 is attached to the substantially central portion of the high resistance tube 3 so as to come in contact with the electrode layer 9 through an aperture 16 (see FIG. 6A) formed through the high resistance tube 3. As shown in FIG. 2, the $G_4$ pin 15 is connected with a lead wire 26. This lead wire 26 is connected to the stem pin 6, though not shown.

Figure 4:
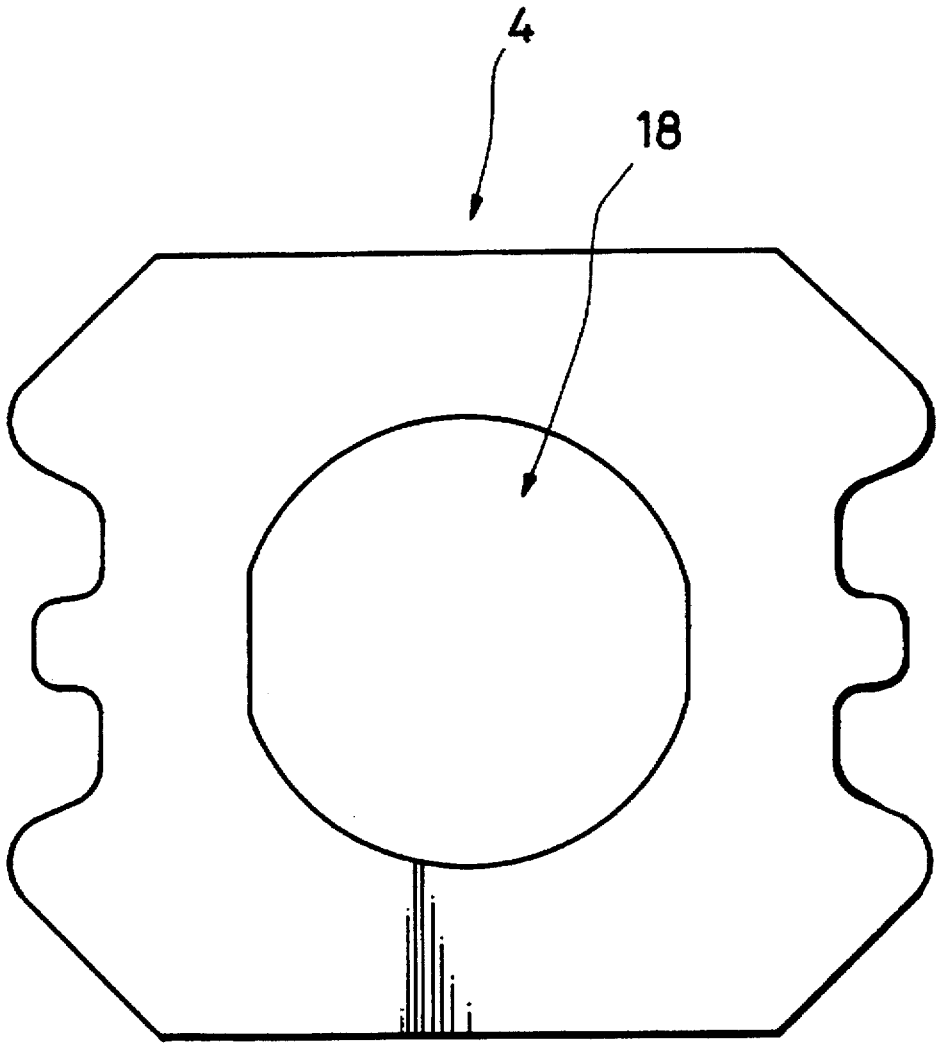
FIG. 4 is a plan view showing an HV shield used in the first embodiment of the present invention.

As shown in FIG. 4, the HV shield 4 is a flat-shaped member made of SUS304 or the like, for example, and has through its central portion an aperture 18 bored to pass the electron beam therethrough. The HV shield 4 is fixed to the cylindrical holder 12 by welding.

The HV spring 5 is made of Inconel, for example. As shown in FIG. 2, the HV spring 5 is-fixed to the respective ends of the HV shield 4 by welding so that its tip end portions press the inner surface of the neck tube 1. The HV spring 5 is electrically connected to an anode button (not shown) through a conductive layer made of a carbon or the like.

A method of manufacturing an electron gun according to the embodiment of the present invention will be described with reference to FIG. 5 and FIGS. 6A through 6F.

Figure 5:
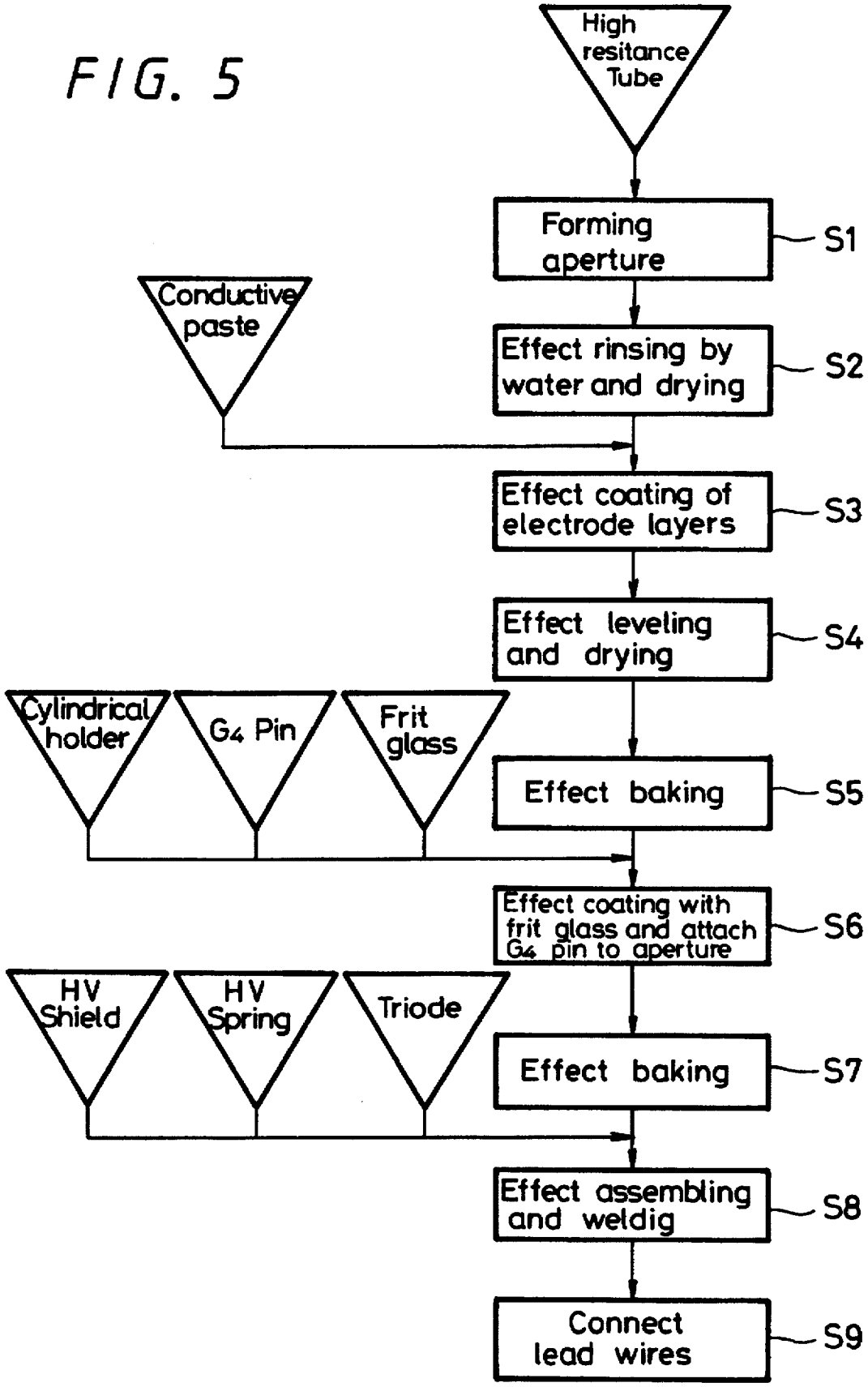
FIG. 5 is a flowchart to which reference will be made in explaining a manufacturing process of the electron gun according to the first embodiment of the present invention.
Figure 6A:
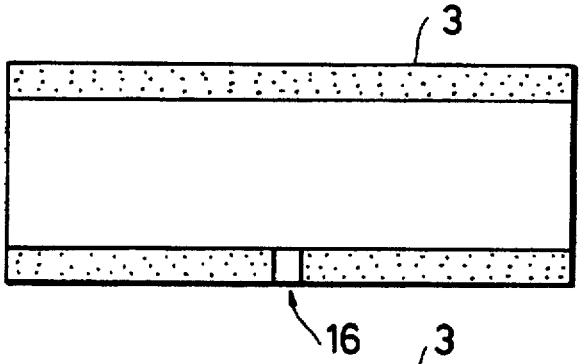
FIGS. 6A through 6F are schematic diagrams used to explain the manufacturing process of the electron gun according to the first embodiment of the present invention.

Initially, the aperture 16 that is used to attach the $G_4$ pin 15 is bored through the high resistance tube 3 as shown in step S1 in FIG. 5 and FIG. 6A. Then, the high resistance tube 3 is rinsed by water and then dried as shown at step S2 in FIG. 5.

Figure 6B:
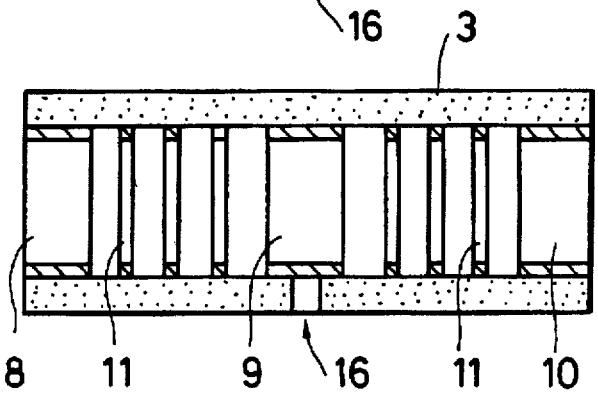

Subsequently, the electrode layers 8 to 10 and the conductive ring 11 are formed on the inner surface of the high resistance tube 3 by coating according to the method below (see step S3 in FIG. 5 and in FIG. 6B). In this case, $RUO_2$-glass paste (manufactured by E.I. du Pont de Nemours & Company under the trade name of #9516) is used as the conductive paste and the coating is carried out so as to form a uniform film thickness.

A first example of a method of forming the electrode layers 8 to 10 and the conductive rings 11 will be described with reference to FIGS. 7A to 7E.

Figure 7A:
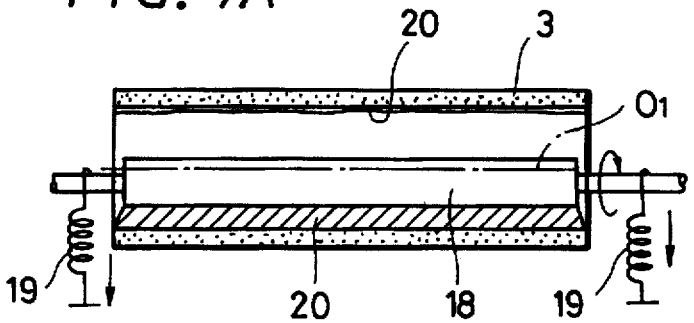
FIGS. 7A to 7E are respectively schematic diagrams used to explain a first example of a method of forming the electrode layers and the conductive ring.
Figure 7D:
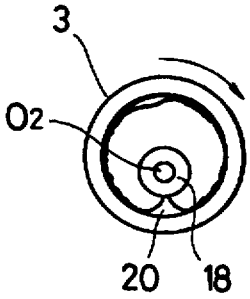
Figure 7B:
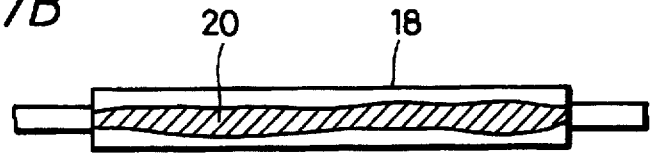

FIGS. 7A and 7D shows a method of coating the conductive paste. As shown in FIGS. 7A and 7D, a rotatable rubber roller 18 having substantially the same length as that of the high resistance tube 3 is put into the inside of the high resistance tube 3, and the rubber roller 18 is urged against the inner surface of the high resistance tube 3 under spring force of a pair of springs 19. In this case, after a conductive paste 20 of a constant amount is put on the rubber roller 18 along its longitudinal direction as shown in FIG. 7B, the rubber roller 18 is set in the inside of the high resistance tube 3 as shown in FIG. 7A, and the high resistance tube 3 is rotated about a rotation axis $O_1$. Thus, the rubber roller 18 also is rotated about a rotation axis $O_2$ to cause the conductive paster 20 to be coated on the whole inner surface of the high resistance tube 3. Thereafter, the rubber roller 18 is ejected from the high resistance tube 3 and then heated by a hot wind, for example, to dry the same, while rotating the high resistance tube 3. Thus, the conductive paste 20 can be prevented from being dropped.

Figure 7C:
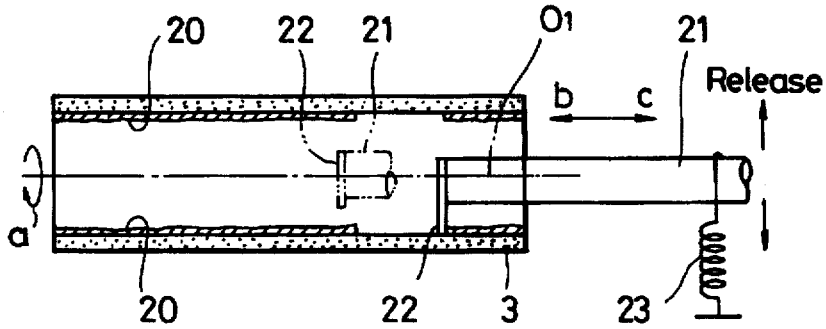
Figure 7E:
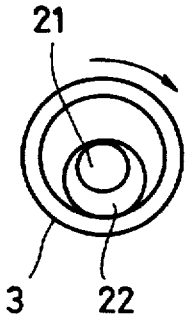

FIG. 7C and 7E shows a method of trimming the conductive paste 20. As shown in FIGS. 7C and 7E, a supporting rod 21 includes a scribing disk 22 made of a cemented carbide attached to its top eccentrically. This supporting rod 21 is on the other hand pulled in the direction perpendicular to the longitudinal direction of the high resistance tube 3 under spring forces of a spring 23. In the trimming process, the high resistance tube 3 is rotated in the direction shown by an arrow a in FIG. 7C, and the supporting rod 21 is disposed within the high resistance tube 3. When the supporting rod 21 is moved in the direction shown by an arrow b or c and then brought to the unnecessary position of the conductive paste 20, the scribing disk 22 is urged against the conductive paste 20 under spring force of the spring 23, thereby trimming the conductive paster 20. On the other hand, the conductive paste 20 is left by releasing the spring 23 on the portion where the conductive paste 20 need be coated. Alternatively, the conductive paste 20 on the unnecessary position may be removed by a heat generated by the absorption of a laser light.

A second example of the method of forming the electrode layers 8 to 10 and the conductive rings 11 will be described with reference to FIGS. 8A through 8D. This method is based on an exposure method using a negative type resist material (e.g., PVA-ADC, etc.).

Figure 8A:
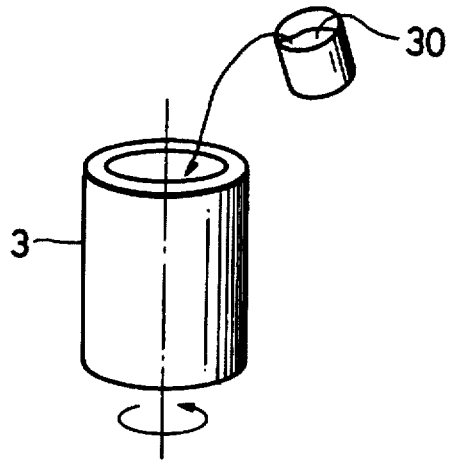
FIGS. 8A through 8D are respectively diagrams showing a second example of the method of forming the electrode layers and the conductive ring.
Figure 8B:
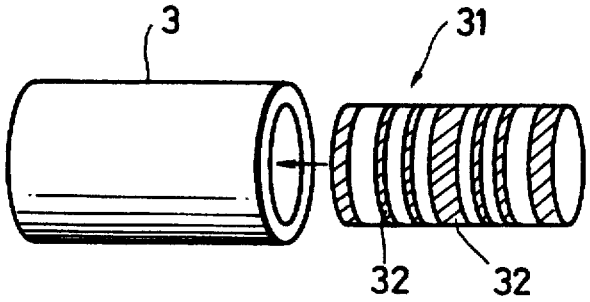

According to this method, as shown in FIG. 8A, a resist material 30 is coated on the inner surface of the high resistance tube 3 while the high resistance tube 3 is being rotated. Subsequently, as shown in FIG. 8B, into the high resistance tube 3, there is inserted a mask 31 and then they are positioned. The mask 31 is produced by forming patterns 32 as the same patterns as those of the electrode layers 8 to 10 and the conductive rings 11 around the outer periphery of ultraviolet transmission glass (e.g., quartz) having the same diameter as the inner diameter of the high resistance tube 3.

Figure 8C:
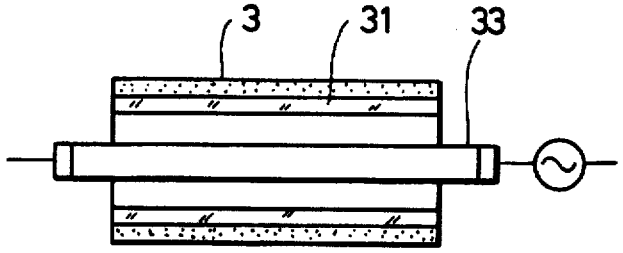
Figure 9A:
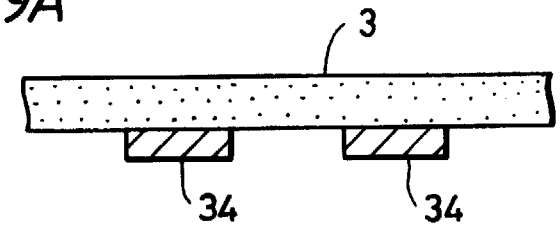
FIGS. 9A to 9C are respectively diagrams used to explain the electrode layers and the conductive ring formed by the second example of the method according to the present invention.

Subsequently, as shown in FIG. 8C, an ultraviolet radiation lamp 33 is disposed within the mask 31 and an exposure is effected by the ultraviolet radiation lamp 33. Then, the development is carried out for the coated resist material by rinsing the same by water after the mask 31 had been removed from the high resistance tube 3, thereby forming electrode patterns of resists 34 as shown in FIG. 9A.

Figure 8D:
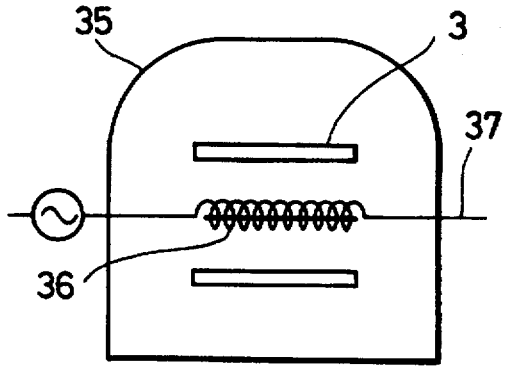
Figure 9B:
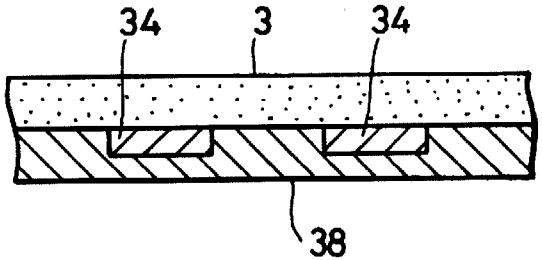
Figure 9C:
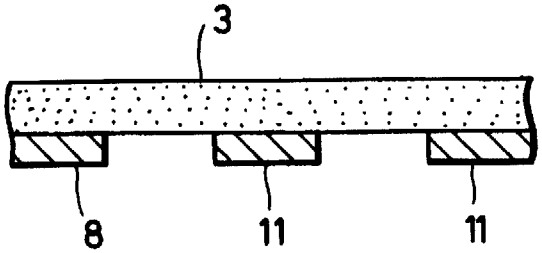

Then, as shown in FIG. 8D, the high resistance tube 3 is disposed within a vacuum pump 35 and a wire 36 made of a metal, such as Al, Au or the like is heated by a heater 37, whereby a metal layer 38 is deposited on the inner surface of the high resistance tube 3 as shown in FIG. 9B. Further, the electrode films 8 to 11 and the conductive ring 11 are formed by carrying out a reverse development using H202 and a baking (at 430° C. for 30 minutes) as shown in FIG. 9C.

Figure 10:
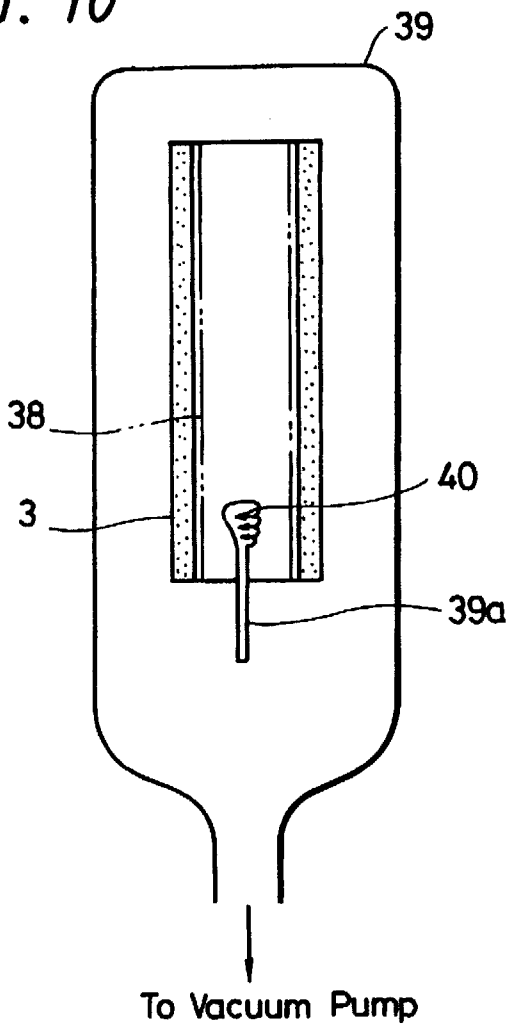
FIG. 10 is a diagram showing a third example of the method of forming the electrode layers and the conductive ring according to the present invention.

A third example of the method of forming the electrode layers 8 to 10 and the conductive rings 11 will be described with reference to FIG. 10 (i.e., metal mask evaporation method). According to this method, a ring-shaped mask 38 made of a metal is fitted into the high resistance tube 3 so as to closely come in contact with the inner surface of the high resistance tube 3. Then, the high resistance tube 3 with the mask 38 is disposed within a vessel 39 coupled to a vacuum pump (not shown). Then, the vessel 39 is made vacuum and an evaporation metal 40 is heated by a heater 39*a* to be deposited on the inner surface of the high resistance tube 3 through the metal ring-shaped mask 38.

A fourth example of the method of forming the electrode layers 8 to 10 and the conductive ring 11 will be described with reference to FIG. 11 (thermal transfer method).

Figure 11A:
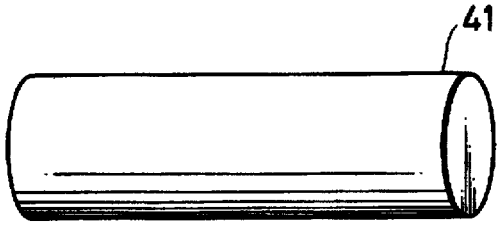
FIGS. 11A through 11E are respectively diagrams used to explain a fourth example of the method of forming the electrode layers and the conductive ring.
Figure 11B:
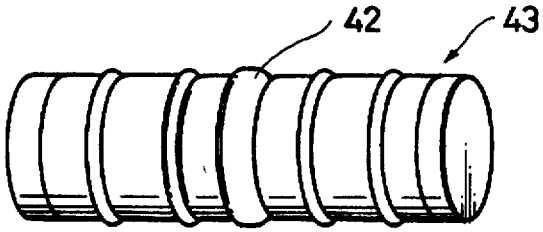
Figure 11C:
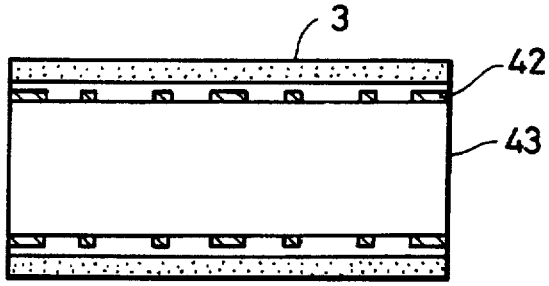
Figure 11D:
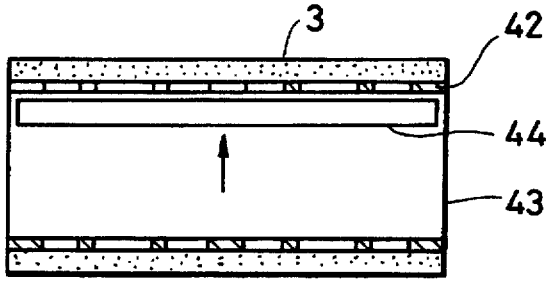

In the case of this method, a thermal transfer base film 41 made of polyester is shaped as a cylinder (see FIG. 11A). A thermal transfer sheet 43 is completed by sequentially coating respective layers of a stripping layer (not shown), conductive layers 42 and a bonding layer (not shown) on the base film 41 (see FIG. 11B). Subsequently, as shown n in FIG. 11C, this thermal transfer sheet 43 is positioned and then inserted into the high resistance tube 3. Then, the thermal transfer sheet 43 is closely brought in contact with the inner surface of the high resistance tube 3 by an air pressure, and heated and then pressed by a silicon roller 44 which incorporates therein a heater (see FIG. 11D). Consequently, the conductive layers 42 on the thermal transfer sheet 43 are thermally transferred on the inner surface of the high resistance tube 3, thereby forming the electrode layers 8 to 10 and the conductive rings 11.

Figure 11E:
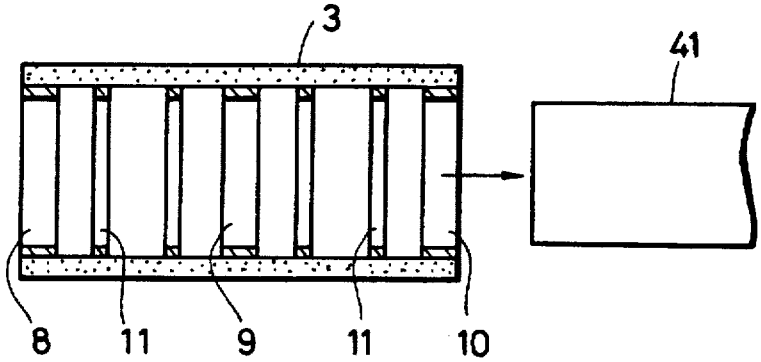

Thereafter, the base film 41 is stripped and removed as shown in FIG. 11E.

Figure 12A:
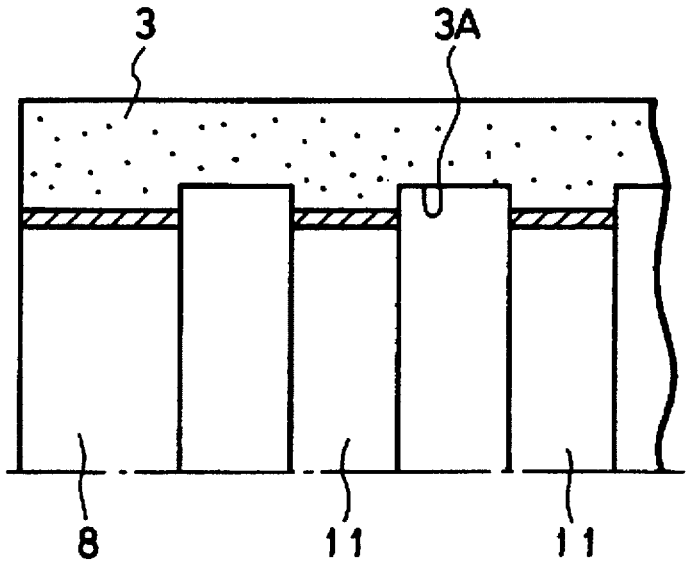
FIGS. 12A and 12B are respectively diagrams showing a fifth example of the method of forming the electrode layers and the conductive ring according to the present invention.
Figure 12B:
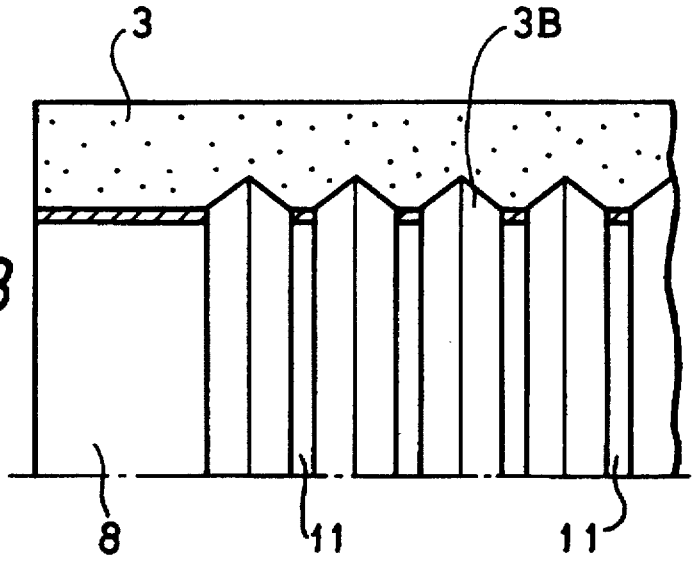

Then, as shown in FIGS. 12A and 12B, concave portions 3A, 3B are formed on the inner wall of the high resistance tube 3 in advance, and the electrode layers 8 to 10 and the conductive rings 11 of the predetermined patterns can be formed by coating the conductive paste 20 on the whole inner surface of the concave portions 3A, 3B by using the rubber roller 18 shown in FIG. 7.

Alternatively, the above-mentioned electrode layers 8 to 10 and the conductive rings 11 can be formed by spraying the conductive paste 20 on the inner surface of the high resistance tube 3 according to an so-called ink jet system.

After the electrode layers 8 to 10 and the conductive rings 11 had been formed by the above-mentioned methods, the leveling and drying are carried out (see step S4 in FIG. 5) in order to keep the film thickness uniform. Thereafter, the product is baked at, for example, 850° C. for 10 minutes in the air (see step S5 in FIG. 5), thereby fixing the electrode layers 8 to 10 and the conductive rings 11 on the inner surface of the high resistance tube 3 made of a ceramic. This baking process becomes unnecessary if the third method (metal mask evaporation method) of the methods of forming the electrode layers 8 to 10 and the conductive rings 11 is used.

Figure 6C:
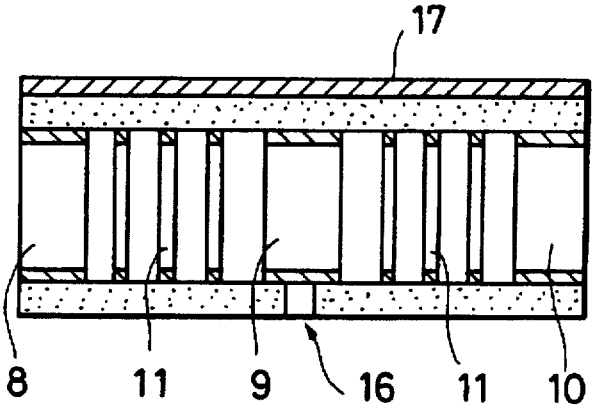

Thereafter, as shown in FIG. 6C, to electrically connect the electrode layer 8 serving as the third grid $G_3$ and the electrode layer 10 serving as the fifth grid $G_5$, a conductive layer 17 is formed by coating the above conductive paste 20 on the outer surface of the high resistance tube 3 in its longitudinal direction on the side in which the $G_4$ pin 15 is not provided.

Figure 6D:
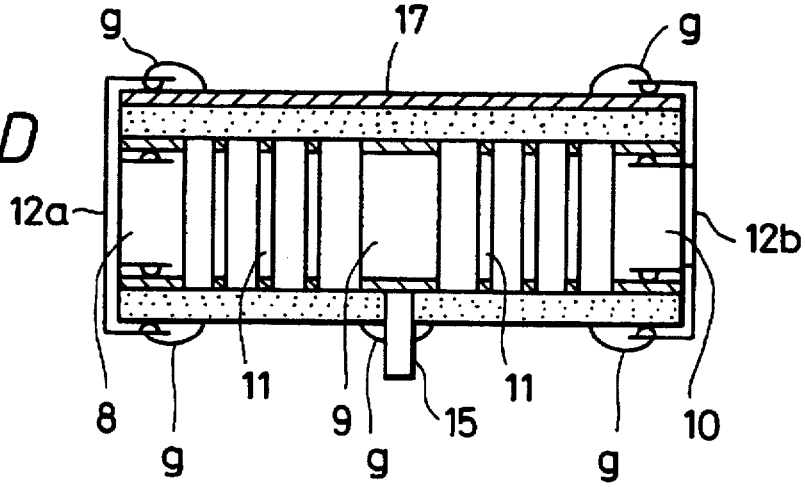

Then, the center of the high resistance tube 3 is determined by a positioning jig, and the cylindrical holders 12*a* and 12*b* are set to the high resistance tube 3. Also, the $G_4$ pin 15 is attached to the aperture 16 and fixed thereto by a jig, which are respectively baked at, for example, 850° C. for 10 minutes through a frit glass g as shown in FIG. 6D (see steps S6, S7 in FIG. 5).

Incidentally, the following variant is also possible. That is, after the electrode layers 8 to 10 and the conductive rings 11 had been formed, the leveling and drying (step S4 in FIG. 5) and the baking process (step S5 in FIG. 5) are not carried out but instead, the cylindrical holders 12 and the $G_4$pin 15 are set and coated with the frit glass g, which are then baked at a time (see step S7 in FIG. 5).

Figure 6E:
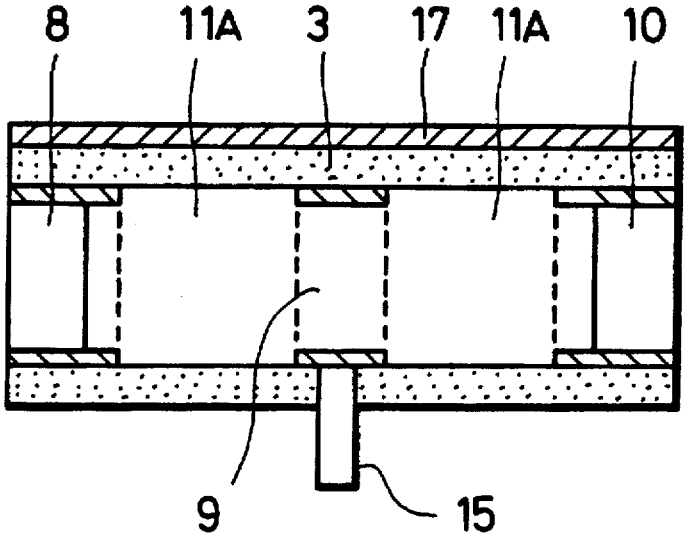
Figure 6F:
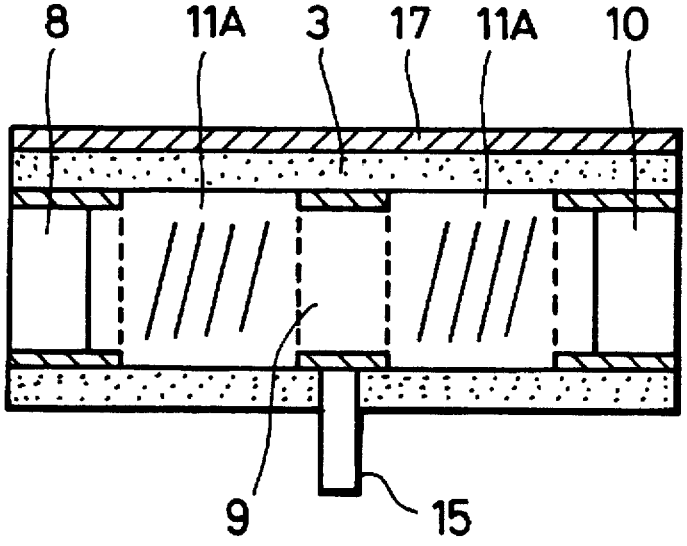

Subsequently, as shown in FIG. 6E, a resistance film 11A is coated on substantially the whole inner surface of the high resistance tube 3, i.e., leaving small portions of the high resistance tube 3 at its the respective ends where the electrode layers 8 and 10 are formed. As the resistance paste, there is used $RuO_2$-glass paste (manufactured by E.I. du Pont de Nemours & Company under the trade name of #9516), and the coating is carried out so as to provide a uniform film thickness according to a method which will be described later on.

Figure 13:
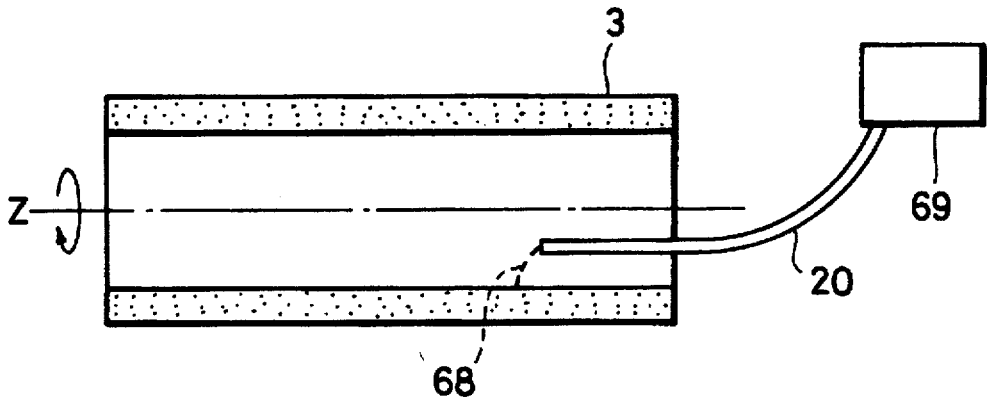
FIG. 13 is a schematic diagram showing an example of a coating method of a resistance paste.

FIG. 13 shows an example of a coating method of the resistance paste. As shown in FIG. 13, the high resistance tube 3 is rotated about the Z axis, i.e., tube axis direction, and a resistance paste 68 of a predetermined amount is supplied to the inner surface of the high resistance tube 3 from a nozzle 60 connected to a tank 69 of the resistance paste 68.

Figure 14:
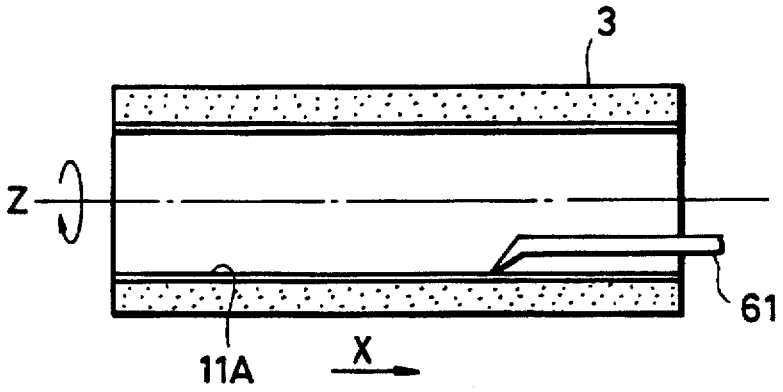
FIG. 14 is a schematic diagram showing an example of a trimming method of a resistance layer.

Then, after the leveling and the drying were effected on the resistance layer 11A, the trimming and the rinsing of the resistance layer 11A are carried out by a method shown in FIG. 14.

FIG. 14 shows an example of a trimming method. More specifically, while the high resistance tube 3 is being rotated about the Z axis, the high resistance tube 3 is moved in the X axis direction and the tip end of a scribing needle 61 is brought in contact with the surface of the resistance layer 11A, thereby the resistance layer 11A being scribed in a spiral or helical fashion. In this case, only the portions that are not overlapped on the electrode layers 8 to 10 are scribed. According to this process, the resistance layers 11A are helically formed between the electrode layers 8, 9 and between the electrode layers 9, 10 (see FIG. 6F). Incidentally, chips produced in the trimming process are completely removed from the high resistance tube 3 by some suitable means, such as a blow of air or the like (rinsing by water).

Figure 15:
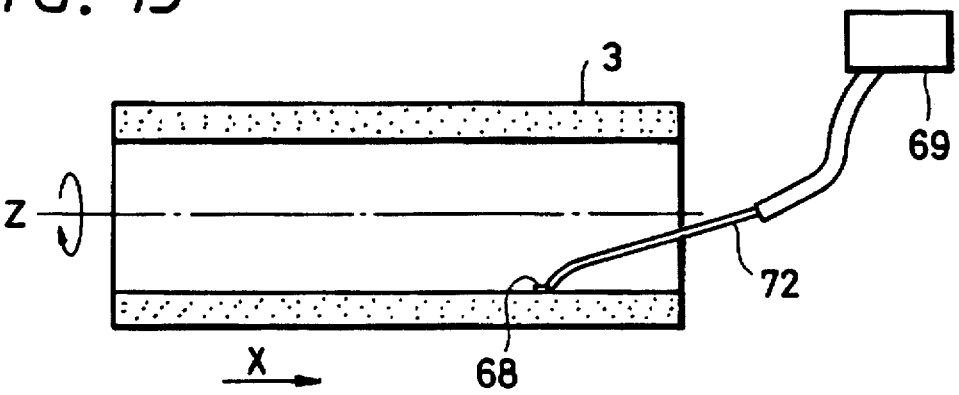
FIG. 15 is a schematic diagram showing an example of a method of forming a helical-shaped resistance layer.

On the other hand, the present invention is not limited to the above-mentioned method, and the resistance layers 11A may be formed in a helical fashion according to the following method. More specifically, after the leveling and the drying were carried out, as shown in FIG. 15, while the high resistance tube 3 is being rotated about the Z axis, the high resistance tube 3 is moved in the X axis direction and the resistance paste 68 can be supplied to the inner surface of the high resistance tube 3 from a dispenser 72 (needle) connected to the tank 69 of the resistance paste 68.

After the helical-shaped resistance film 11A had been formed according to the above-mentioned process, the high resistance tube 3 is baked at, for example, 850° C. for 10 minutes. Thus, the electrode layers 8 to 10 and the resistance layer 11A are dissolved to, fixed to and then stabilized on the high resistance tube 3.

Thereafter, the HV shield 4 and the HV spring 5 are assembled on and welded to one cylindrical holder 12*a* by using the positioning jig. Whereas, the triode (cathode K, the first grid $G_1$, the second grid $G_2$ and the cup-shaped member $GA_{3A}$) assembled in advance by the well-known beading method is assembled on the other cylindrical holder 12*b* by using the positioning jig and then welded thereto (see step S8 in FIG. 5).

Further, the electron gun shown in FIG. 2 is formed by connecting the lead wires 24, 25 of the first and second grid $G_1$, $G_2$ and the lead wire 16 of the $G_4$ pin 15 to the stem pins 6 embedded into the stem 2 (step S9 in FIG. 5).

Figure 16:
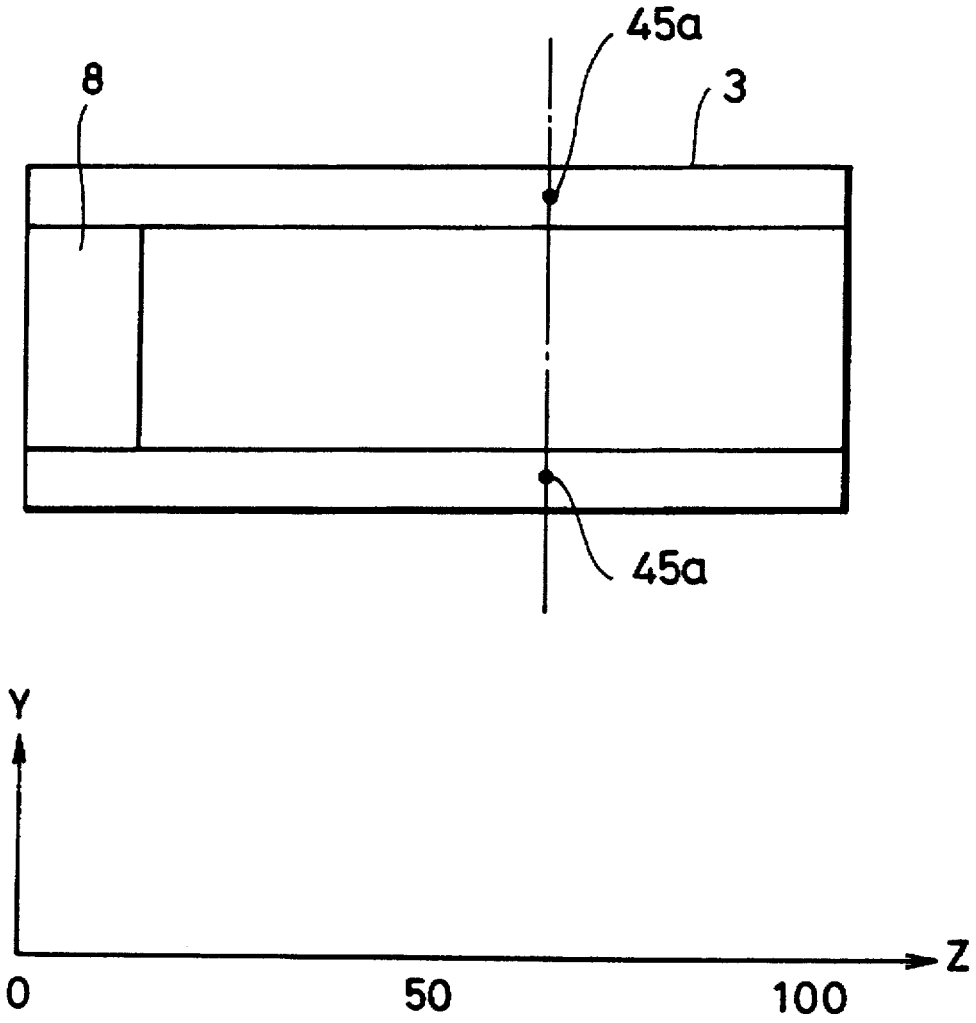
FIG. 16 is a schematic diagram used to explain the role of the conductive ring.
Figure 17A:
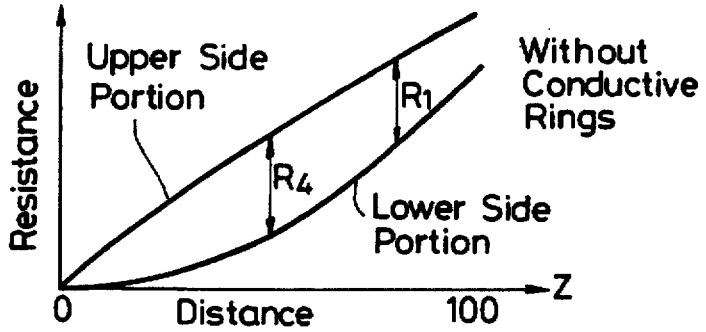
FIGS. 17A through 17D are respectively graphs used to explain the role of the conductive ring according to the present invention.
Figure 17B:
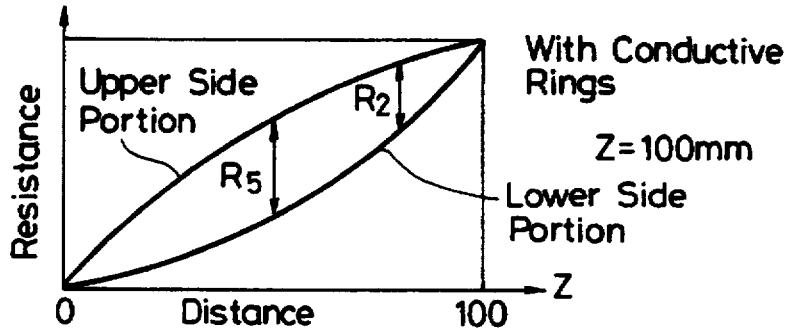

The conductive rings 11 thus formed according to the above-mentioned processes can function as follows:

As shown in FIGS. 16 and 17A, a resistance on the surface of the inner wall of the high resistance tube 3 is fluctuated in its upper portion 45*a* and in its lower portion 45*b*. However, if the conductive rings 11 are provided on the high resistance tube 3 in its longitudinal direction (Z axis direction) and in its vertical direction (Y axis direction) according to the embodiment of the present invention, then the potentials in the Y axis direction are made equal so that the fluctuation of the resistance can be avoided.

Figure 17C:
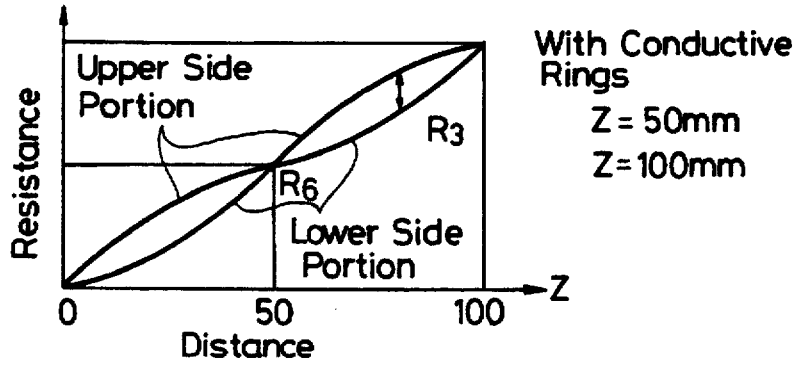

When the electrode layer 8 is provided at the position of Z=0 mm and the conductive ring 11 is provided at the position of Z=100 mm as shown in FIG. 14B, for example, resistance scattered values among the electrode layers 8 to 10 and the conductive ring 11 are reduced much more if the conductive ring 11 is provided ($R_1>R_2$, $R_4>R_5$). If the conductive ring 11 is provided at also the position of Z=50 mm, then as shown in FIG. 17C, the resistance scattered values can be further reduced ($R_2>R_3$, $R_5>R_6=0$).

Consequently, when the conductive ring 11 is provided among the electrode layers 8 to 10 as seen in the embodiment of the present invention, a spherical aberration of the electron lens system formed by the electrode layers 8 to 10 can be reduced. Then, as the number of the conductive rings 11 provided is increased and the accuracy with which the conductive rings 11 are provided is increased, there can be achieved similar effects that are achieved when the concentricity of the members forming the electron gun is reduced in the conventional apparatus.

Figure 17D:
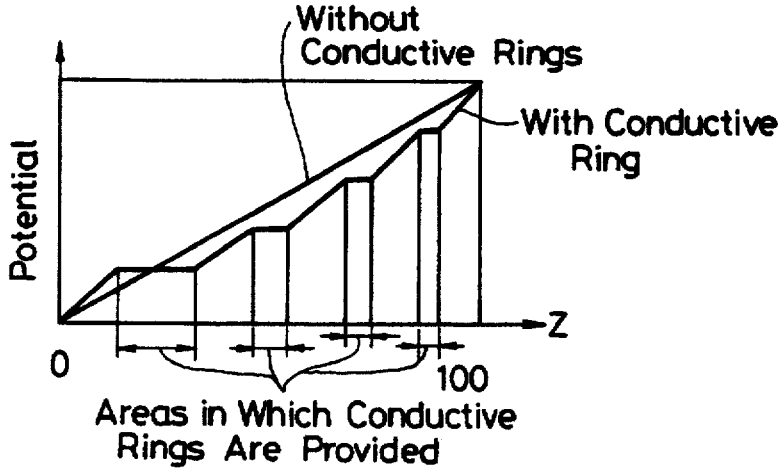

Further, potentials among the electrodes can be fine adjusted by changing the pitch and width of the conductive rings 11 as shown in FIG. 17D.

In the electron gun thus arranged according to the embodiment of the present invention, since the electrode layers 8 to 10 corresponding to the third to fifth grids $G_3$ to $G_5$ forming the main lens are formed integrally with the high resistance tube 3 formed with a high accuracy, axial displacement of these electrode layers 8 to 10 relative to the Z axis can be reduced. Therefore, according to the embodiment of the present invention, the axial displacement of the electron beam can be suppressed.

Figure 18:
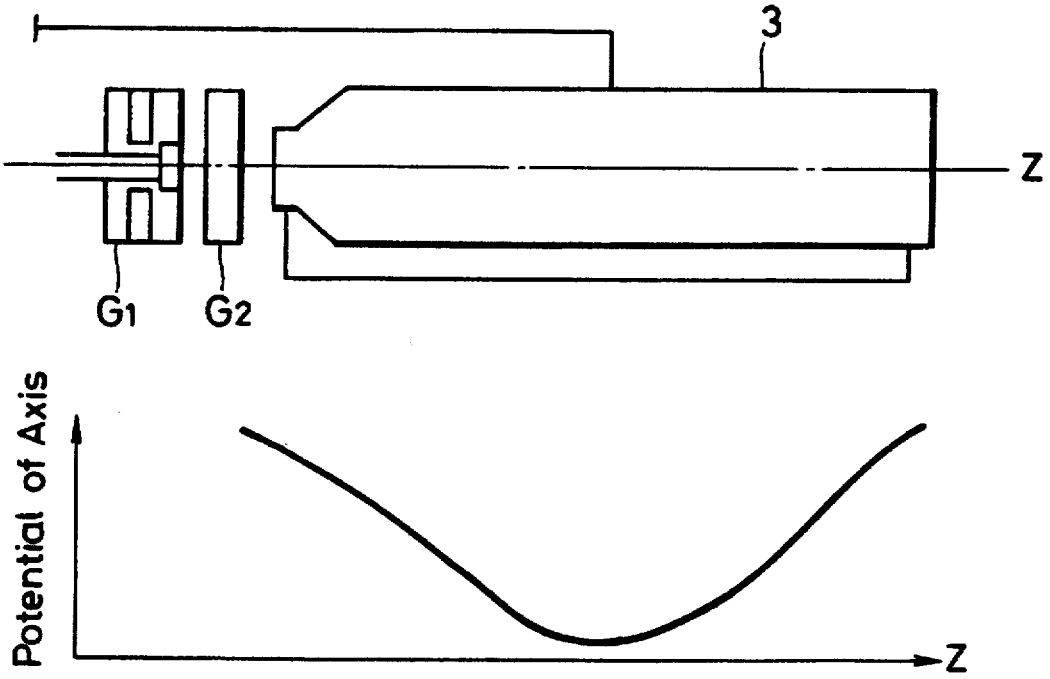
FIG. 18 is a diagram used to explain a principle of the effects achieved by this embodiment.

Further, according to the embodiment of the present invention, since a plurality of conductive rings 11 are formed among the electrode layers 8 to 10, as shown in FIG. 18, a potential gradient (changing ratio of electric field intensity) among the electrode layers 8 to 10 can be reduced as compared with the example of the prior art with the result that a discharge among the electrode layers 8 to 10 becomes difficult to occur. Further, since the spherical aberration can be reduced as described above, the spot diameter of the electron beam can be reduced and therefore a resolution can be improved.

In this case, since the high resistance substance exists among the electrode layers 8 to 10, the third to fifth grids $G_3$ to $G_5$ that form a desired main lens can be obtained by providing the conductive rings 11 of which number is less than that needed when electrodes are formed on a cylindrical member of low resistance value and the helical-shaped resistor members are provided among the electrodes. As a result, the electron gun can be manufactured with ease.

Further, since the conductive rings 11 according to this embodiment is formed in the vertical direction relative to the Z axis, potentials among the electrode layers 8 to 10 can be stabilized. According to the embodiment of the present invention, since a current flows in parallel to the Z axis within the high resistance tube 3, a magnetic field is not generated within the high resistance tube 3, and hence the displacement of the electron beam can be prevented.

While the electrode layers 8 and 10 are connected through the conductive layer 17 and the cylindrical holders **12*a*, 12*b* as described above, the present invention is not limited thereto and the cylindrical holders 12*a*, 12*b*** can be connected by lead wires, for example.

Figure 19:
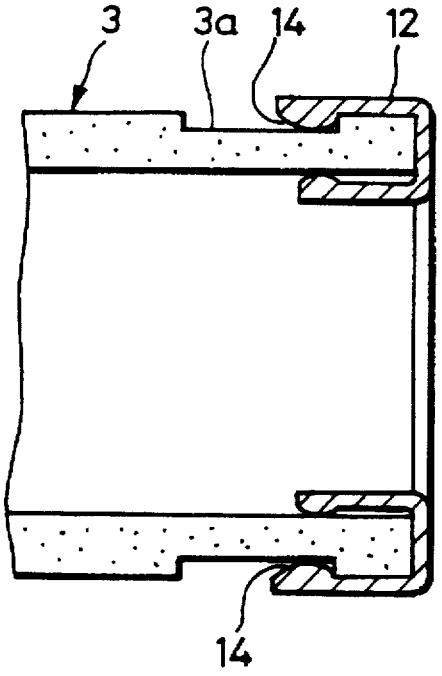
FIG. 19 is a cross-sectional view showing other example of a method of attaching the cylindrical holder according to the present invention.

While the cylindrical holders **12*a*, 12*b* are fixed to the high resistance tube 3 by using the frit glass g as shown in FIG. 6D, for example, the present invention is not limited thereto and the following variant is also possible. That is, as shown in FIG. 19, for example, a concave portion 3*a* is formed on the outer surface of the high resistance tube 3 and the concave portion 3*a* and the protrusion 14 of the cylindrical holder 12 are fitted each other. In this case, the HV shield 4 and the cylindrical holder 12 may be welded in advance. Further, the HV shield 4 and the HV spring 5** may be fixed not by the welding but by the insertion.

In addition, the number of the protrusions 14 provided on the cylindrical holder 12 is not limited to those described in the embodiment of the present invention and an arbitrary number of the protrusions 14 can be selected inasmuch as there are provided a plurality of protrusions 14.

Further, while only the first grid $G_1$, the second grid $G_2$ and the third grid member $G_{3A}$ are fixed by using the bead glass 7 as described above, the present invention is not limited thereto and the HV shield 4 can also be fixed together with the first grid $G_1$, the second grid $G_2$ and the third grid member $G_{3A}$ by extending the bead glass 7, for example. With this structure, a stronger electron gun can be assembled. In this case, the first grid $G_1$, the second grid $G_2$, the third grid member $G_{3A}$ and the HV shield 4 can be fixed by the bead glass 7 in the last assembly process of the electron gun.

Figure 20A:
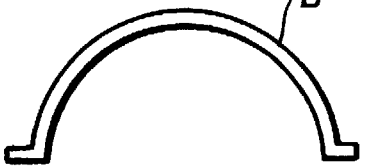
FIGS. 20A and 20B are schematic diagrams showing other example of a method of fixing the high resistance tube according to the present invention.
Figure 20B:
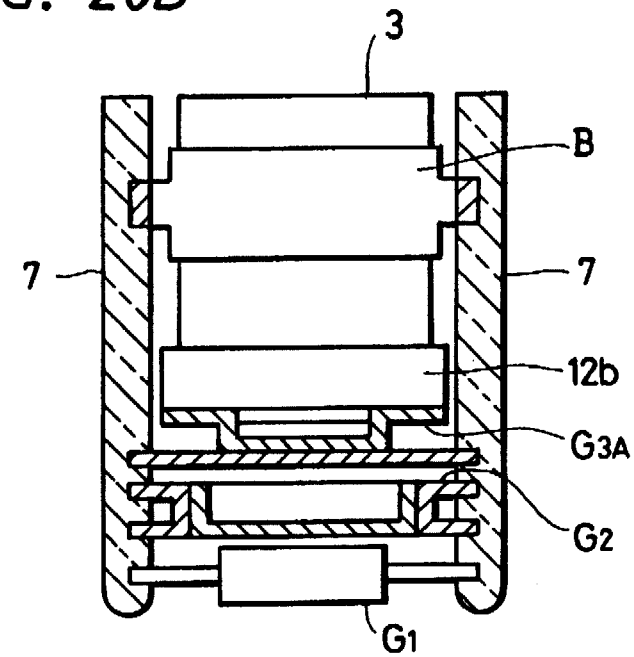

Further, the bead glass 7 need not be extended to the HV shield 4 but as shown in FIGS. 20A and 20B, the high resistance tube 3 is sandwiched by a pair of band-shaped belts B and the bead glass 7 is extended up to the intermediate portion of the high resistance tube 3, whereafter the high resistance tube 3 and the triode can be fixed by melt bonding the belts B to the bead glass 7.

Furthermore, the present invention can be applied not only to the above-mentioned unipotential type electron gun but also to a bipotential type electron gun.

Figure 21:
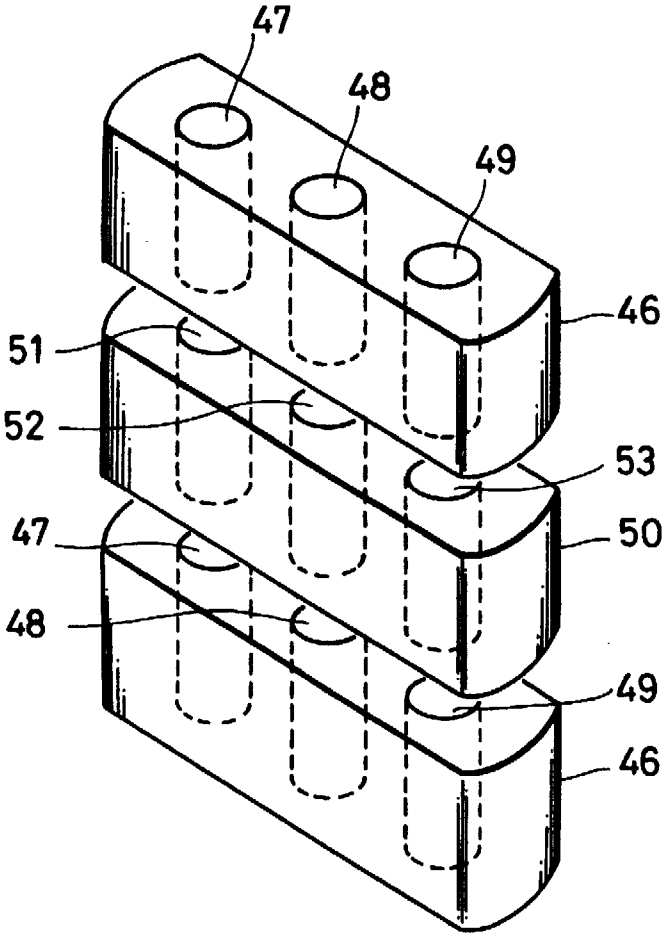
FIG. 21 is a perspective view showing a main portion of a second embodiment of the present invention.

FIG. 21 is a perspective view showing a main portion of the electron gun according to a second embodiment of the present invention. As shown in FIG. 21, according to the second embodiment of the present invention, red, green and blue electron beam passing apertures 47 to 49 are respectively formed through high resistance ceramic members 46 of substantially a rectangular shape made of the same material as that of the high resistance tube 3. A metal member 50 of the same shape as those of the two high resistance ceramic members 46 and which has bored therethrough apertures 51 to 53 corresponding to the apertures 47 to 49, respectively is fixed between the two high resistance ceramic members 46. In this case, it is preferable that axes of the corresponding apertures 47 to 49 and 51 to 53 are prevented from being displaced one another. This metal member 50 plays a role of the fourth grid $G_4$ and connected with a lead wire (not shown). Further, the third and fifth grids $G_3$, $G_5$ (not shown) are provided on the upper surface and the lower surface of the upper and lower high resistance ceramic members 46, respectively. These third and fifth grids $G_3$ and $G_5$ are constructed of the metal plates or flat conductive films. Then, the conductive rings 11 are formed on the inner surfaces of the respective apertures 47 to 49 of the high resistance ceramic member 46.

Figure 22A:
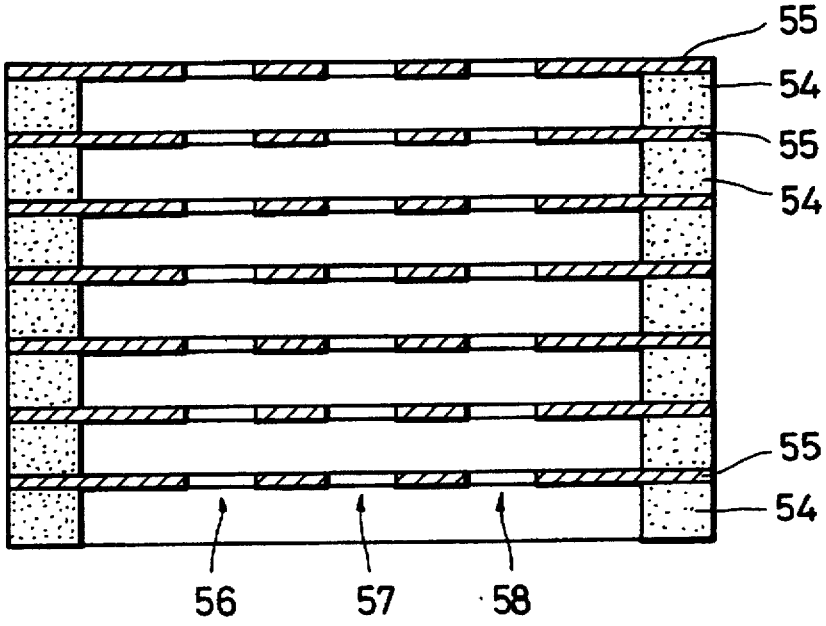
FIGS. 22A and 22B are respectively a cross-sectional view and a plan view showing a main portion of a third embodiment of the present invention.
Figure 22B:
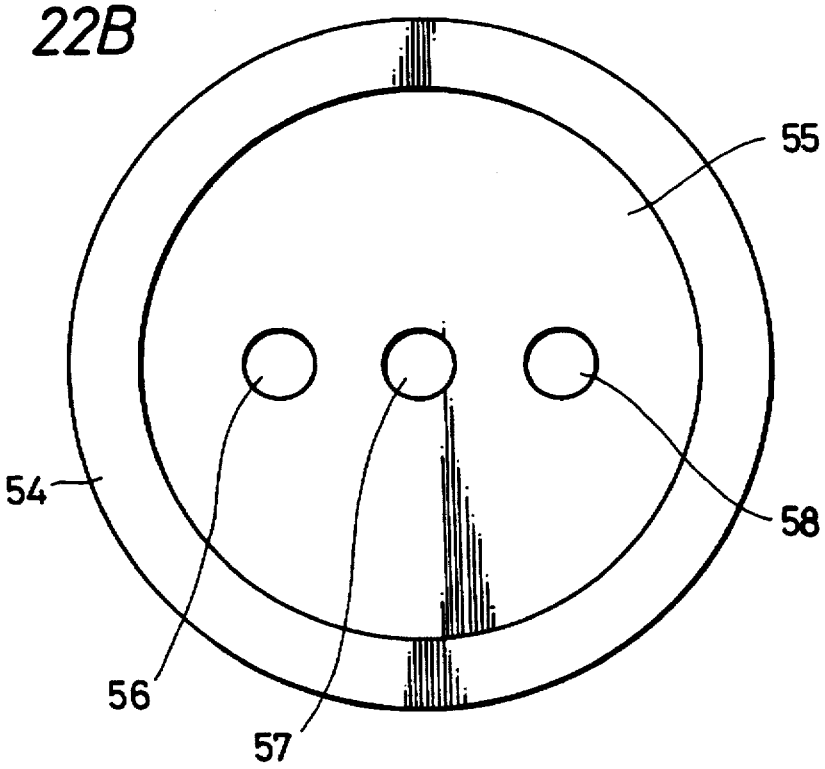

FIGS. 22A and 22B show a main portion of a third embodiment of the present invention. In accordance with this embodiment, a plurality of ring-shaped members 54 made of the high resistance ceramic material similar to the second embodiment are laminated and a disk-shaped metal plate 55 is sandwiched between the adjacent ring-shaped members 54. Herein, electron beam passing apertures 56 to 58 are formed through each of the metal plates 55. While the present embodiment is applied to the 3-beam electron gun, this arrangement can also be applied to the single-beam electron gun shown in FIG. 2.

As described above, according to the present invention, since the resistor cylindrical member having the electrodes forming the main lens which converges the electron beam is made of the high resistance substance, the displacement of the concentricity of the main lens system can be suppressed and the axial displacement of the electron beam can be reduced.

Further, according to the present invention, since the potential gradient between the electrodes constructing the main lens is reduced, the discharge between the electrodes can be prevented. In addition, since the spherical aberration of the main lens can be reduced, the diameter of the beam or the beam spot can be reduced and therefore the resolution can be improved.

Furthermore, since the conductive terminal of the fourth grid is led out from the predetermined position of the resistance cylindrical member, the axial potential can be fined adjusted with the result that the spherical aberration of the main lens can be reduced more.

The electron gun of the present invention can be manufactured with ease by forming the electrodes or low resistance layers by coating the conductive paste on the inner surface of the resistance cylindrical member by using the roller.

Having described preferred embodiments of the invention with reference to the accompanying drawings, it is to be understood that the invention is not limited to those precise embodiments and that various changes and modifications could be effected therein by one skilled in the art without departing from a spirit or scope of the invention as defined in the appended claims.

What is claimed is:

1. An electron gun for a cathode ray tube comprising:

at least one tube;

first and second holders for holding corresponding first and second ends of said tube;

a plurality of electrode layers which are provided on an inner surface of said tube so as to form a part of a main lens;

at least one conductive layer provided exclusively on a first outer side surface of said tube; and a plurality of electrodes for forming a part of a triode.

2. The electron gun as recited in claim 1, further comprising a resistive layer provided on the inner surface of said tube, and said resistive layer has a resistance value lower than that of said tube.

3. The electron gun as recited in claim 1, wherein the resistance value of said tube falls in a range of from 100MΩ to 1 TΩ.

4. The electron gun as recited in claim 1, wherein said conductive layer is provided between two of said electrode layers.

5. The electron gun as recited in claim 1, wherein said tube is made of a ceramic.

6. The electron gun as recited in claim 1, wherein said tube is formed of a ceramic including oxides selected from a group of aluminum, titanium, tungsten and copper.

* * * * *